US005632132A

United States Patent [19]

Kuipers et al.

[11] Patent Number: 5,632,132

[45] Date of Patent: May 27, 1997

[54] PACKETS AND THEIR MANUFACTURE

[75] Inventors: Jan Kuipers, Goudswaard, Netherlands; Simon C. Martin, Meriden; Geoffrey W. Vernon, Kenilworth, both of Great Britain; Petrus W. Van Der Zon, Zwijndrecht, Netherlands

[73] Assignee: Thomas J. Lipton Co., Division of Conopco, Inc., Englewood Cliffs, N.J.

[21] Appl. No.: 456,995

[22] Filed: Jun. 1, 1995

Related U.S. Application Data

[62] Division of Ser. No. 321,192, Oct. 11, 1994, abandoned.

[30] Foreign Application Priority Data

Oct. 12, 1993 [GB] United Kingdom ..... 9321034
Jan. 19, 1994 [GB] United Kingdom ..... 9400977

[51] Int. Cl.[6] ..... B65B 29/04

[52] U.S. Cl. ..... 53/413; 53/134.2; 493/375; 426/79

[58] Field of Search ..... 53/410, 413, 134.2, 53/134.1; 493/214, 225, 226, 344, 357, 375, 376; 426/79, 80

[56] References Cited

U.S. PATENT DOCUMENTS

| | | |
|---|---|---|
| 1,723,702 | 8/1929 | Mitchell . |
| 1,775,347 | 9/1930 | Hirschhorn . |
| 2,149,713 | 3/1939 | Webber . |
| 2,308,241 | 1/1943 | Hogaboom, Jr. . |
| 2,335,159 | 11/1943 | Salfisberg . |
| 2,359,271 | 9/1944 | Sidebotham . |
| 2,406,018 | 8/1946 | Irmscher . |
| 2,466,281 | 4/1949 | Shaw . |
| 2,468,464 | 4/1949 | Salfisberg . |
| 2,556,383 | 6/1951 | Williams . |
| 2,606,836 | 8/1952 | McCabe . |
| 2,791,505 | 5/1957 | Barmett . |
| 2,819,167 | 1/1958 | Irmscher . |
| 2,852,389 | 9/1958 | Johnson . |
| 2,860,989 | 11/1958 | Geisinger . |

(List continued on next page.)

FOREIGN PATENT DOCUMENTS

| | | |
|---|---|---|
| 118215 | 3/1944 | Australia . |
| 14035/88 | 10/1989 | Australia . |
| 0 448 325 | 9/1991 | European Pat. Off. . |
| 0 489 554 | 6/1992 | European Pat. Off. . |
| 0 448 325 | 8/1993 | European Pat. Off. . |
| 1 169 388 | 12/1958 | France . |
| 1 022 960 | 1/1958 | Germany . |
| 1 281 927 | 10/1968 | Germany . |
| 1 654 971 | 4/1971 | Germany . |

OTHER PUBLICATIONS

Abstract of DE 1 022 960.
Abstract of JP 5044111.
Copending application Serial No. 08/321,191.
Copending application Serial No. 08/321,192.

*Primary Examiner*—Lowell A. Larson
*Assistant Examiner*—Ed Tolan
*Attorney, Agent, or Firm*—James J. Farrell

[57] ABSTRACT

Packets containing a flowable material are provided with a draw-string or thread to squeeze the packet contents. The packet envelope is formed from a doubled-over web which gives the packet a folded-over edge and which encloses an intermediate portion of the thread close to the folded-over edge. The end portions of the web extend from the intermediate portion of the thread to extend through the opposite edge of the packet. The external ends of the thread are secured to a tag which is attached to the outer face of the envelope. The thread intermediate portion is retained close to said one edge by heat seal means. Apparatus is also described for producing the packets in a continuous or semi-continuous manner.

9 Claims, 14 Drawing Sheets

U.S. PATENT DOCUMENTS

| | | | |
|---|---|---|---|
| 2,861,403 | 11/1958 | Weisman . | |
| 2,878,927 | 3/1959 | Haley . | |
| 2,881,910 | 4/1959 | Murphy . | |
| 2,925,171 | 2/1960 | Eaton . | |
| 2,939,257 | 6/1960 | Bartelt . | |
| 2,986,269 | 5/1961 | Goldberg . | |
| 3,092,242 | 6/1963 | Irmscher . | |
| 3,143,834 | 8/1964 | Irmscher . | |
| 3,191,355 | 6/1965 | Morpurgo . | |
| 3,223,229 | 12/1965 | Welin-Berger . | |
| 3,237,550 | 3/1966 | Christopher . | |
| 3,283,672 | 11/1966 | Mueller . | |
| 3,316,686 | 5/1967 | Welin-Berger . | |
| 3,396,032 | 8/1968 | McCrae et al. . | |
| 3,415,656 | 12/1968 | Lundgren . | |
| 3,539,355 | 11/1970 | Kasakoff . | |
| 4,288,224 | 9/1981 | Romagnoli | 493/375 |
| 4,415,597 | 11/1983 | Romagnoli . | |
| 4,506,490 | 3/1985 | Klar . | |
| 4,680,185 | 7/1987 | Illk . | |
| 4,735,810 | 4/1988 | Dacal . | |
| 4,828,851 | 5/1989 | Romagnoli . | |
| 4,829,742 | 5/1989 | Romagnoli . | |
| 4,856,257 | 8/1989 | Romagnoli | 493/375 |
| 4,961,301 | 10/1990 | Bonomelli | 493/375 |
| 4,977,728 | 12/1990 | Rambold | 493/357 |
| 5,135,762 | 8/1992 | Vernon et al. . | |
| 5,366,741 | 11/1994 | Van der Zon . | |
| 5,399,224 | 3/1995 | Vernon et al. . | |

FOREIGN PATENT DOCUMENTS

| | | |
|---|---|---|
| 870 516 | 12/1987 | Germany . |
| 8707075 U | 12/1987 | Germany . |
| 3 807 763 | 9/1988 | Germany . |
| 3 826 911 | 2/1990 | Germany . |
| 570 798 | 12/1975 | Switzerland . |
| 0 809 573 | 2/1959 | United Kingdom . |
| 0 962 038 | 6/1964 | United Kingdom . |
| 1 541 054 | 6/1964 | United Kingdom . |
| 2 049 547 | 12/1980 | United Kingdom . |
| 2 052 428 | 1/1981 | United Kingdom . |
| 2 094 267 | 9/1982 | United Kingdom . |
| 2 151 214 | 7/1985 | United Kingdom . |
| 2 201 934 | 9/1988 | United Kingdom . |
| 2 202 819 | 10/1988 | United Kingdom . |
| 2 231 023 | 11/1990 | United Kingdom . |
| WO 91/13580 | 9/1991 | WIPO . |
| WO 92/06903 | 4/1992 | WIPO . |
| WO 92/14649 | 9/1992 | WIPO . |
| WO 93/19997 | 10/1993 | WIPO . |
| WO 94/22721 | 10/1994 | WIPO . |

PACKETS AND THEIR MANUFACTURE

This is a Divisional application of Ser. No. 08/321,192 filed Oct. 11, 1994 abandoned.

BACKGROUND OF THE INVENTION

This invention relates to a method and apparatus for producing packets containing a flowable material, in particular but not necessarily exclusively an infusible material such as tea or coffee, equipped with means for applying pressure to express liquid from the packets after infusion, and to packets having such means.

It is well known that when using infusion packets such as tea or coffee bags, a significant part of the infusion remains in the bag unless it is wrung or squeezed out. Many proposals have been made to allow this to be done without having to touch the bag itself, by providing threads or draw-strings that can be pulled to contract the bag. In the examples of U.S. Pat. No. 3,539,355, 3,237,550, 2,881,910, 2,878,927 and 2,466,281 the draw-string is threaded through holes in the bag walls but that has the immediate disadvantage that the infusible material can easily leak out before use. In addition, the holes weaken the bag walls and, especially when the bag has been wetted, bring the risk of tearing the bag as the threads are pulled, and releasing more of the solid infusible material.

WO91/13580 shows analogous examples in which the thread may be retained at desired locations by staples driven through the bag walls, which similarly create leakage paths and local weaknesses at regions where the thread tension is likely to be applied to the bag.

Other proposals are disclosed in U.S. Pat. No. 3,415,656, and WO92/06903 which show bags which have their main envelope formed by two rectangular layers of sheet material heat-sealed together around their edges. A loop of thread is held in the bag by being trapped in the heat sealed margins at least at one region of those margins remote from one end of the bag where the ends of the loop emerge through the heat sealed margin at that end. This arrangement introduces another potential problem in that the heat seal where the thread is trapped is placed under stress when the bag is contracted and if it fails the bag is opened. Since this is likely to occur at the lower end of the bag, the solid contents would be spilled immediately. It may also be noted that these earlier proposals do not suggest how the infusion packets they describe can be economically produced.

SUMMARY OF THE INVENTION

According to one aspect of the present invention a packet containing flowable material and comprising an envelope formed of heat sealable material within which the flowable material is enclosed, and a draw-string or thread for squeezing the contents of the packet, said thread comprising an intermediate portion retained between the opposite walls of the envelope adjacent one side edge of the packet, respective end portions of the thread extending through the envelope interior to have lengths projecting from the envelope at a region remote from said retained portion, the external lengths being laid against an external face of the envelope and being secured to tag means, attached to the exterior of the envelope.

The periphery of the envelope may conveniently be sealed by heat seal means and the intermediate portion of the thread may be retained also by heat seal means. In particular forms of the invention this may be achieved by extension or widening of said peripheral heat seals or by heat seals separate from said peripheral heat seals but adjacent said one side edge.

In a packet of this form it is possible to arrange that the thread is held securely in a manner that allows an effective squeezing action to be obtained when the ends are pulled without creating local stresses that will tear the bag. At the same time it is possible to employ the envelope material in an economic manner, making it feasible to infuse substantially the same amount of material effectively without increasing the overall size of the packet.

In one preferred form of the invention, the peripheral heat seals have an increased width adjacent the ends of said one side edge of the packet for the thread to be held by these widened seals, and the respective thread ends emerge from the packet adjacent the ends of the side edge of the packet opposite said one edge.

According to another aspect of the invention, there is provided an infusion packet comprising an envelope containing the flowable material and a draw-string or thread for contracting said envelope, the thread having an intermediate portion located between opposite walls of the envelope and retained adjacent one edge of the envelope, and respective end portions that extend from the retained intermediate portion to the exterior through an opposite edge of the envelope, the external lengths of said end portions being secured to tag means releasably attached to the exterior of a side face of the envelope.

In this form of the invention the packet may be formed by doubling over a sheet of web material that is to form the envelope, rather than by sealing together two layers of web material.

Preferably said external end portions of the thread extend over one outer side face between said ends, and continue over the opposite outer side face of the packet where they are secured to the tag means which are releasably attached to said opposite side face.

This arrangement is able to provide an ample length of free thread to facilitate the squeezing of liquid from the packet. At the same time it can lend itself to a higher rate of production of the packets without the risk of stoppages due to the entanglement of the thread on the exterior of the packets.

The invention also includes a method of manufacturing packets each provided with means for contracting the packet to squeeze its contents, comprising the steps of bringing a thread together with a row of tags to lay along said row, forming loops of the thread and attaching the ends of each loop to the respective tag, bringing one face of a web material of the packet envelope against the tags and thread loops with portions of the loops remote from said tagged ends overhanging a side edge of the material, bringing said remote portions of the loops over the opposite face of the web material and attaching it thereto, and doubling over the web to a tubular form to locate said loop portions within the tubular form and the tagged ends of the loops on the exterior of the tubular form.

Such a process can be operated in a continuous manner with the successive stages being completed as the parts move towards a filling station where flowable material is deposited in the tubular form web after the thread and tags have been put in place. After filling, the sealed individual packets are of course separated.

It is possible, however, to operate the process in a step-wise manner. For example it can be arranged that the row of tags is progressed in a step-wise manner and the web material of the packet envelope is progressed step-wise in synchronism with said progressing of the tags, and wherein the placing of the web material against respective tags and thread loops, the bringing said thread loop portions over the opposite face of the web material and attaching them thereto being effected during the intervals between said movements.

It will be understood that the steps of the process can be carried out in a different order from that in which they are stated. For example, the doubling of the web to a tubular form can be carried out before or after the stated thread loop portions are brought over and attached to said opposite face of the web.

The present invention also provides apparatus for producing packets with a tag thread or draw-string, said apparatus comprising transport means on which tags and thread are brought together and means are provided for forming loops of thread and for attaching ends of the loops to respective tags, means for bringing the tag-thread assemblies together with a web of envelope material and placing the tags against one face of said web with the portion of each loop remote from said one end overlapping a side edge of the web, means for placing said overlapping portions of the thread loops over the opposite face of the web and attaching them thereto, means for forming the web into a tubular shape with said loop portions in the interior thereof and said tagged ends on the exterior thereof, and means for heat sealing between opposite faces of the web for forming the individual packets with a thread loop and tag associated with each said packet.

Such apparatus can be arranged to operate in a continuous manner or in a series of movement steps.

The invention will be described by way of example with reference to the accompanying drawings.

DESCRIPTION OF THE PREFERRED EMBODIMENTS

Figure 1:
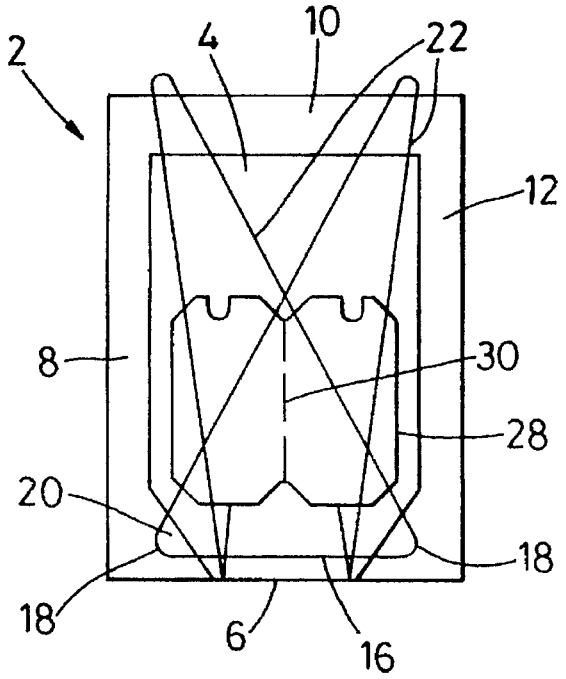
FIGS. 1 and 2 illustrate a form of infusion packet according to the invention, FIG. 1 showing the thread wrapped around the packet, as manufactured, and FIG. 2 showing the packet ready for use but omitting the internal run of the thread.
Figure 2:
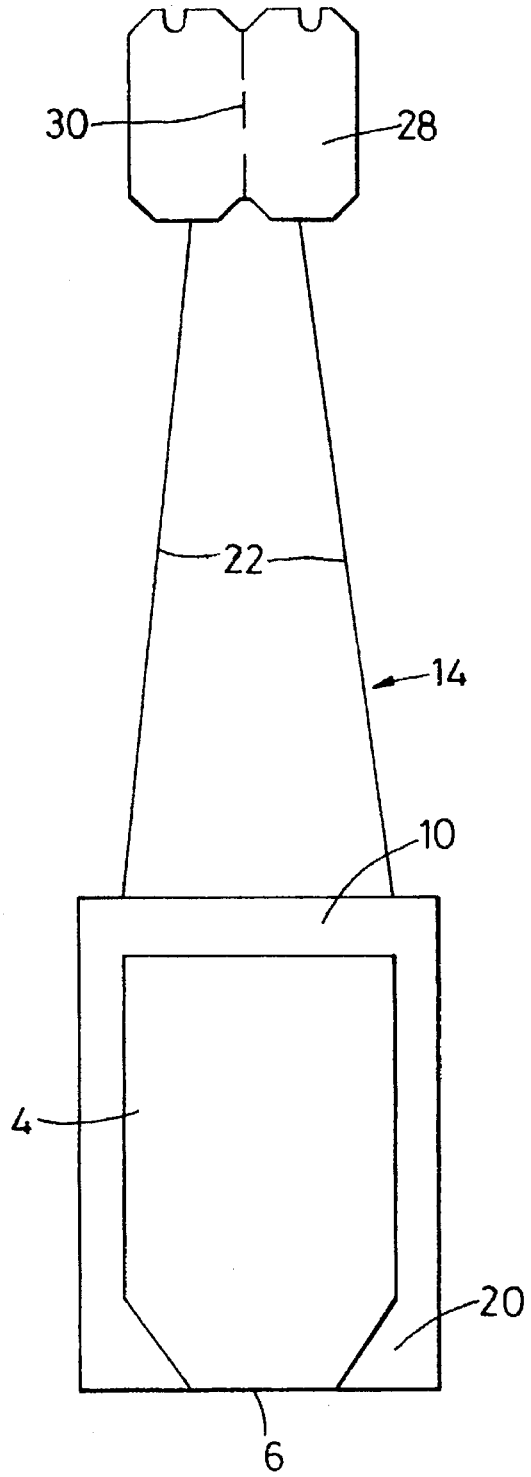

The infusion packet 2 of the example illustrated in FIGS. 1 and 2 is a rectangular packet having an envelope 4 formed by doubling over a web of heat sealable paper along a centre line which then forms one side edge 6 of the packet, and sealing the web layers together by peripheral heat seals 8,10,12 along the other three side edges, typically over a width of some 3 mm. The packet has a draw-string or thread 14 which extends through its interior. A central portion 16 of the thread close to the folded edge has bends or bights 18 at its ends which are located in wider regions 20 of the heat seals adjacent the folded edge 6 to secure the central portion 16 of a thread in the interior of the packet. The free end portions 22 of the thread run from the bends 18 through the packet interior to the side edge 10. From there the two end portions 22 continue over one external face of the packet to the folded edge 6 and around that edge over the opposite face to be secured to a tag 28 removably attached to the latter face. The tag 28 has a central line of weakening 30 formed by perforations and the two thread ends 22 are secured to portions of the tag on opposite sides of the perforations.

While FIG. 1 shows the packet as manufactured, FIG. 2 shows it ready for use with its tag 28 detached from the side of the bag and the thread ends 22 unwrapped. The free length of thread allows the bag to be manipulated while held suspended from the tag to accelerate the infusion process. The tag portions can then be separated along the line of weakening 30 and pulled to draw the thread ends apart. The thread is not made of a heat sealable material (it may be of cotton, for example). When pulled the end portions are therefore able to slide through the sealed edge 10 of the bag but the thread is still retained by its bends 18 in the heat seal regions remote from the edge 10. The bag envelope is thereby contracted and its contents squeezed to increase the extraction of infused liquid from it.

Figure 3:
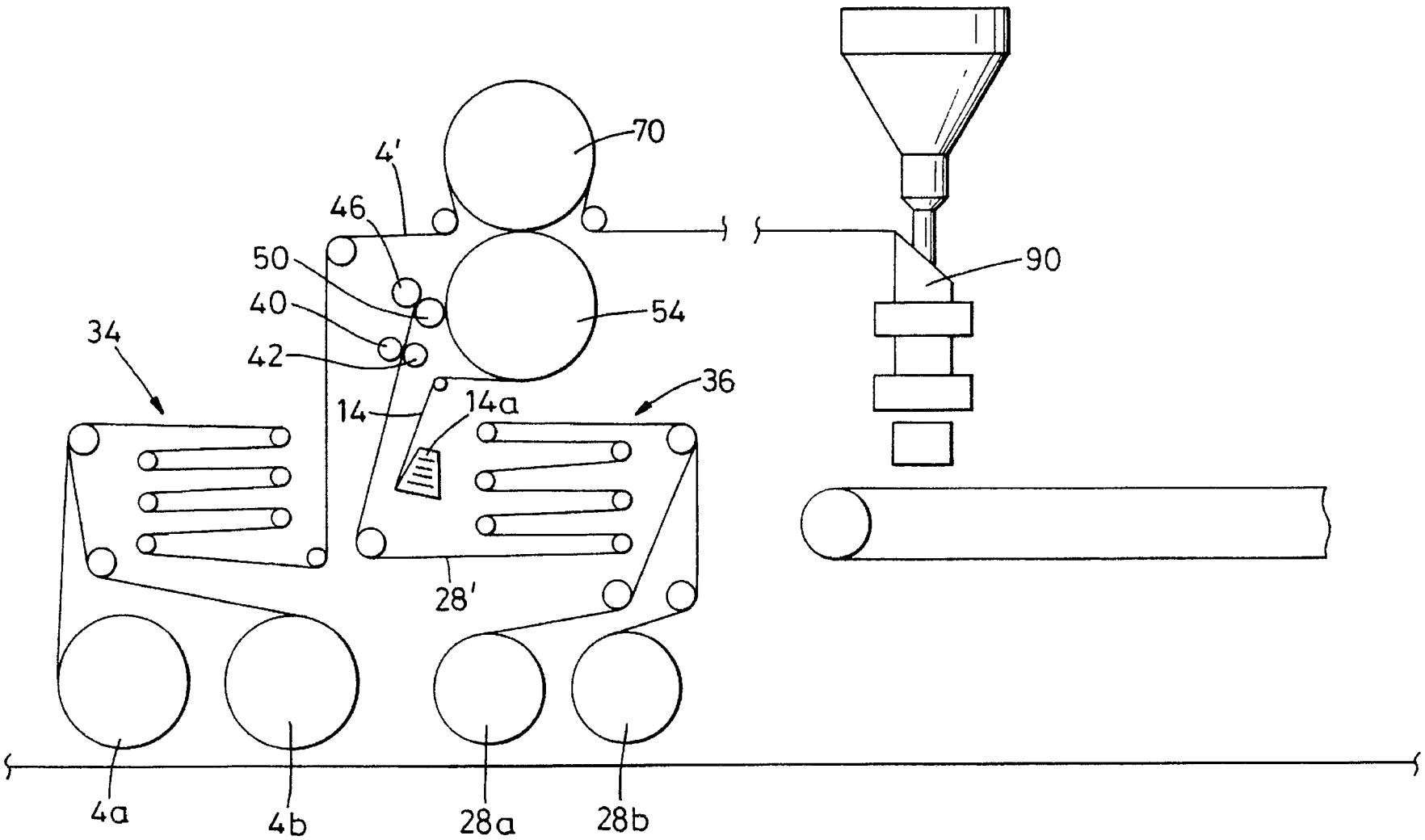
FIG. 3 is a schematic illustration of apparatus for producing the packets of FIGS. 1 and 2, more detailed diagrammatic views of which appear in the following figures.

This form of packet is particularly suited for volume manufacture, e.g. of tea bags, and a preferred form of apparatus for assembling together the tags, thread and web will be described with reference to FIGS. 3 to 9. FIG. 3 is a diagrammatic illustration of the apparatus in which tag material is fed as a continuous strip 28' from a reel 28*a*, web envelope material 4' is fed from a further reel 4*a* and thread 14 is fed from a spool 14*a*. Back-up reels 4*b*,28*b* of web and tag materials are illustrated, and reservoir roller groups 34,36 forming meander paths for both to allow the reels to be changed without stopping the operation of the apparatus.

Figure 4:
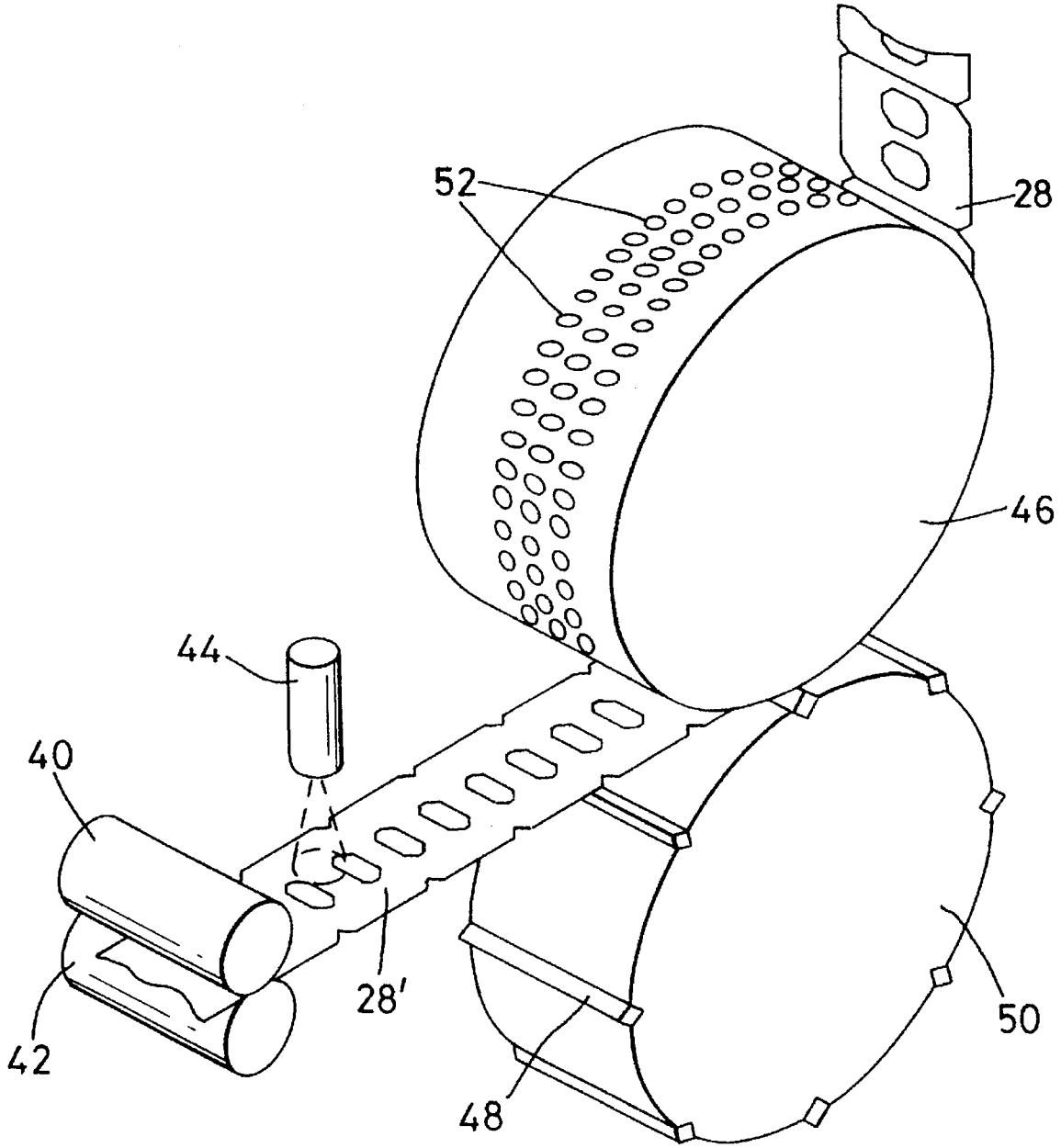
FIGS. 4 and 5 are illustrations of the tag cutting process and the transfer of the tag to a first assembly drum.
Figure 5:
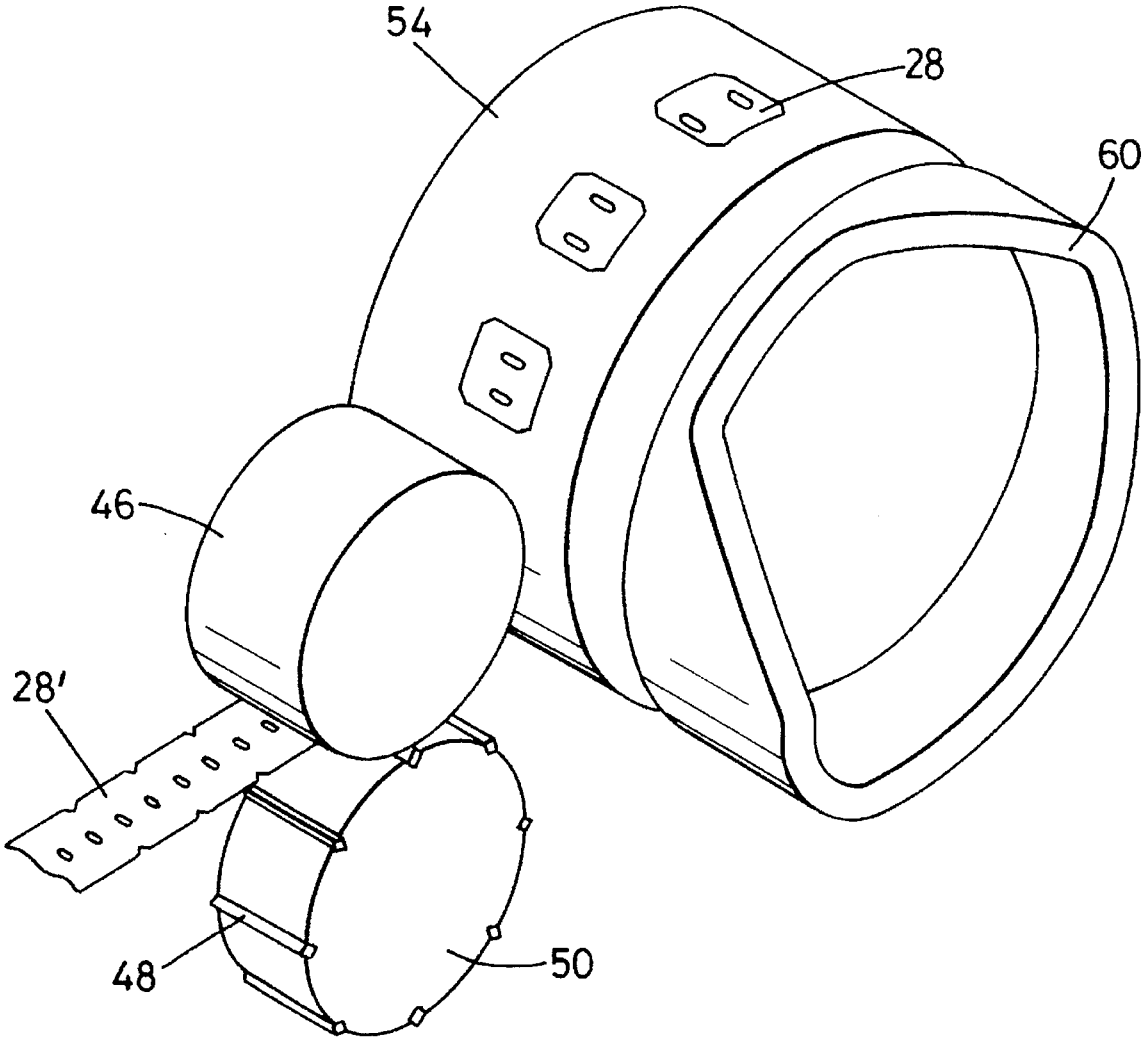

The tag strip 28' is taken through a pair of draw rollers 40,42 driven under the control of an optical sensor 44 (FIG. 4). The sensor 44 scans the strip 28' for a chosen feature, such as a printed panel or an edge profile, and controls the draw roller drive to keep the strip in register with the cutter that follows. The cutter comprises a vacuum roller 46 providing an anvil for a series of cutter bars 48 mounted on a counter-rotating roller 50. Individual tags 28 are severed by a crush cut as the strip 28 enters between the rollers 46,50. The separated tags 28 are retained on the vacuum roller 46 by the suction at vacuum ports 52 on the roller periphery and are carried towards a first transport drum 54 which runs close to the vacuum roller 46, preferably at a spacing no more than the tag thickness.

The drum 54 is provided with a series of suction pads 56 at regular intervals around its periphery and it rotates at a faster speed than the vacuum roller 46 so that the suction pads 56 come in turn into register with successive tags held as a continuous series on the vacuum roller. The suction on the roller 46 and drum 54 is controlled so that as each tag registers with a pad 56 on the drum, suction is applied to that pad but is cut off from the opposing region on the roller 46. The tags are thus transferred onto the drum where they are held in a circumferentially spaced series by the pads 56.

Figure 6:
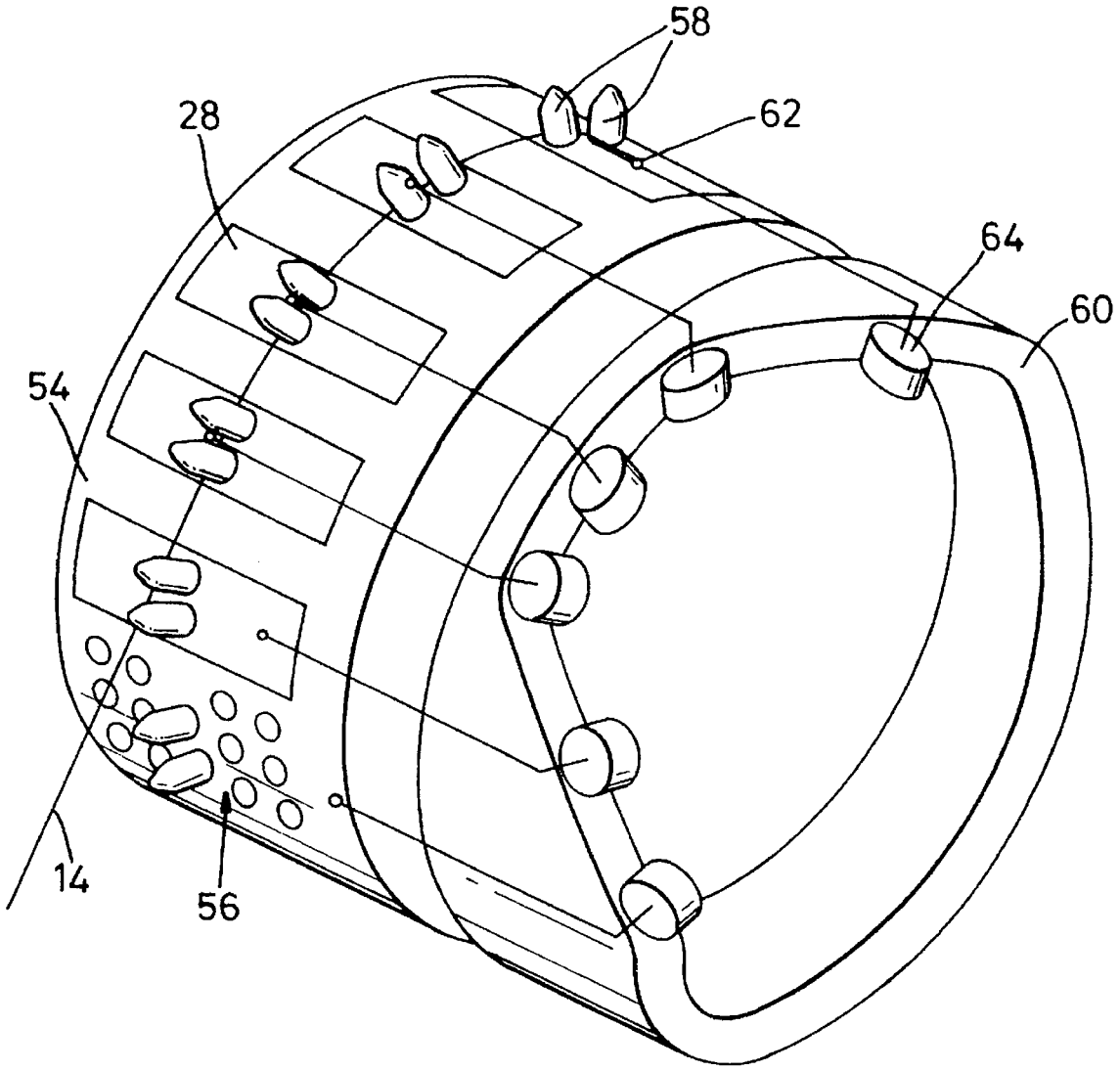
FIGS. 6 and 7 are illustrations of the assembly of the thread with the tags on the first drum.

The thread from the spool 14*a* is drawn onto the first drum 54 over the tags 28. FIG. 6 illustrates how, at each suction pad 56, a pair of pins 58 project from the drum through prepared apertures in the tags 28, and the thread 14 is laid onto the drum and tags to one side of these pins 58 remote from a cam track 60 coaxial with the drum but fixed in position. In FIG. 6 and following figures the tags are shown purely schematically.

Each suction pad 56 has associated with it a displaceable hook 62 which rotates with the drum but is guided to slide axially of the drum between the pair of fixed pins 58 in the area of the suction pad. At their ends remote from the pins, the displaceable hooks 62 carry follower rollers 64 which run on the fixed cam track 60 to control the axial movements of the pins. The cam track profile is so arranged that each hook 62 is held retracted axially away from its associated suction pad 56 before the tag is placed on that pad and is slid forward between the placing of the tag and thread on the pad to lie between the tag and the thread. It is then retracted, so drawing the thread with it and forming a lengthy loop of thread 14' (FIG. 7) between the fixed pins 58.

The loop 14' is held by the hook 62 while the drum carries it past means (not shown) which fold the tags over the ends of the loops on the pins 58. At this stage both ends of each loop are attached to their tag, whether by virtue of a heat sealing coating on the faces of the tag between which the thread is trapped, or by hot melt or cold adhesive.

Figure 7:
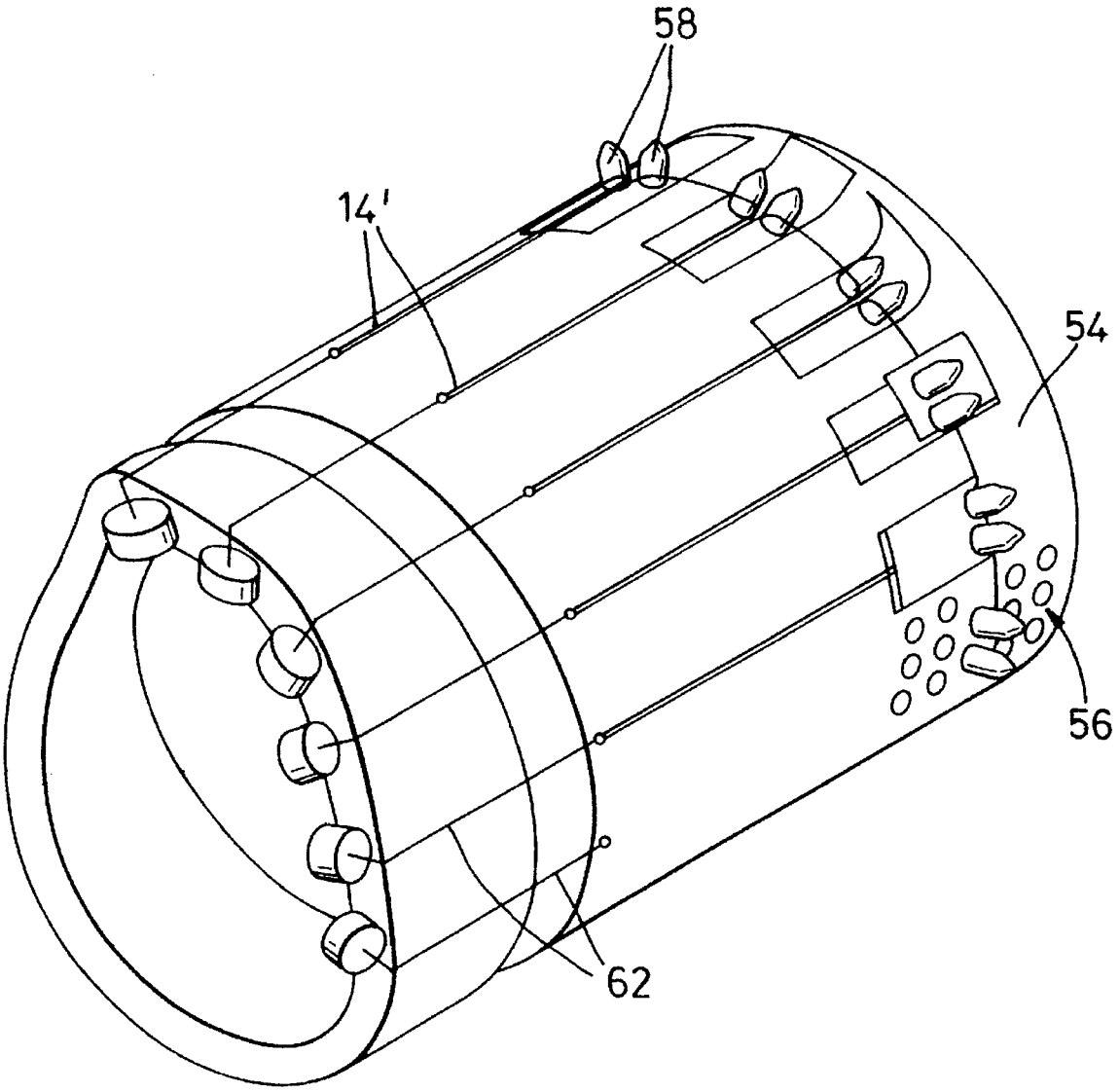
Figure 8:
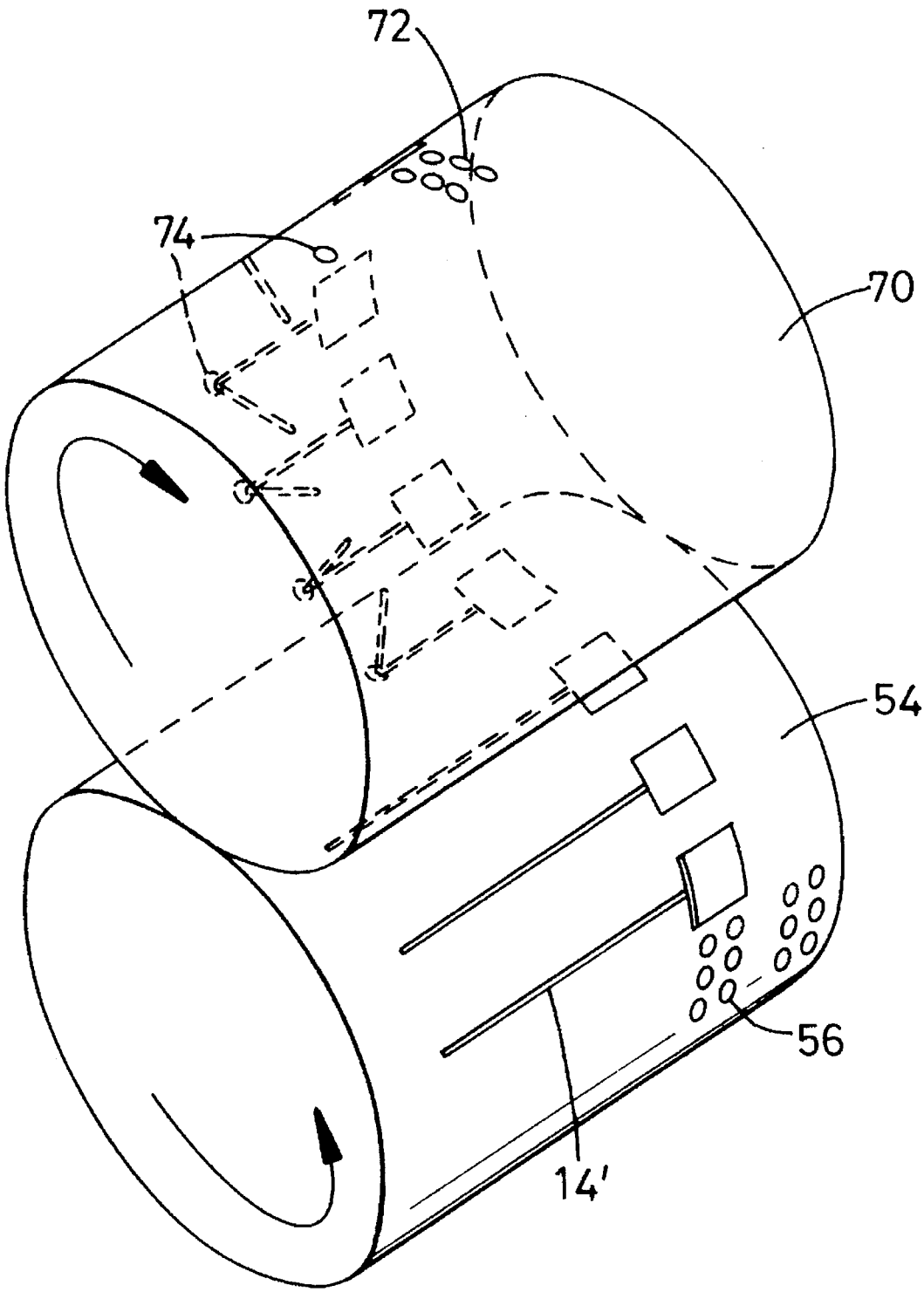
FIG. 8 is an illustration of the transfer of the tag-thread assemblies to a second drum.

FIG. 7 also illustrates the folding of the tag by a stationary deflection blade (not shown) occupying a sector adjacent the path of the drum. As the tags move past the blade, an end of each tag is lifted and is progressively doubled over. The tags conveniently comprise a heat sealable material so that the two halves are securable together by heat when they are doubled over, and the ends of the thread are also fixed to the tag by this operation. If single layer tags are to be provided, they can be placed on the drum 54 to one side of the pins.

As the adhesive bond between the tag and thread cools and sets, the assembly drum brings them towards a second transport drum 70 provided with a corresponding series of suction pads 72. As will be described below the second drum also receives the packet envelope web material 4'. The spacing between the drums 54,70 is preferably no more than the tag thickness and as each tag reaches the second drum it is released from the drum 54 and attached to the drum 70 by switching the suction connections between the respective suction pads 56,72 on the two drums in the same manner as the transfer from the vacuum roller.

At the same time, a release device (not shown) on the second drum 70 detaches the thread loop from its hook 62 on the first drum 54. The freed end of the loop is drawn into a port 74 adjacent the associated suction pad 72 on the second drum, the port being simultaneously connected to the suction source.

Figure 9:
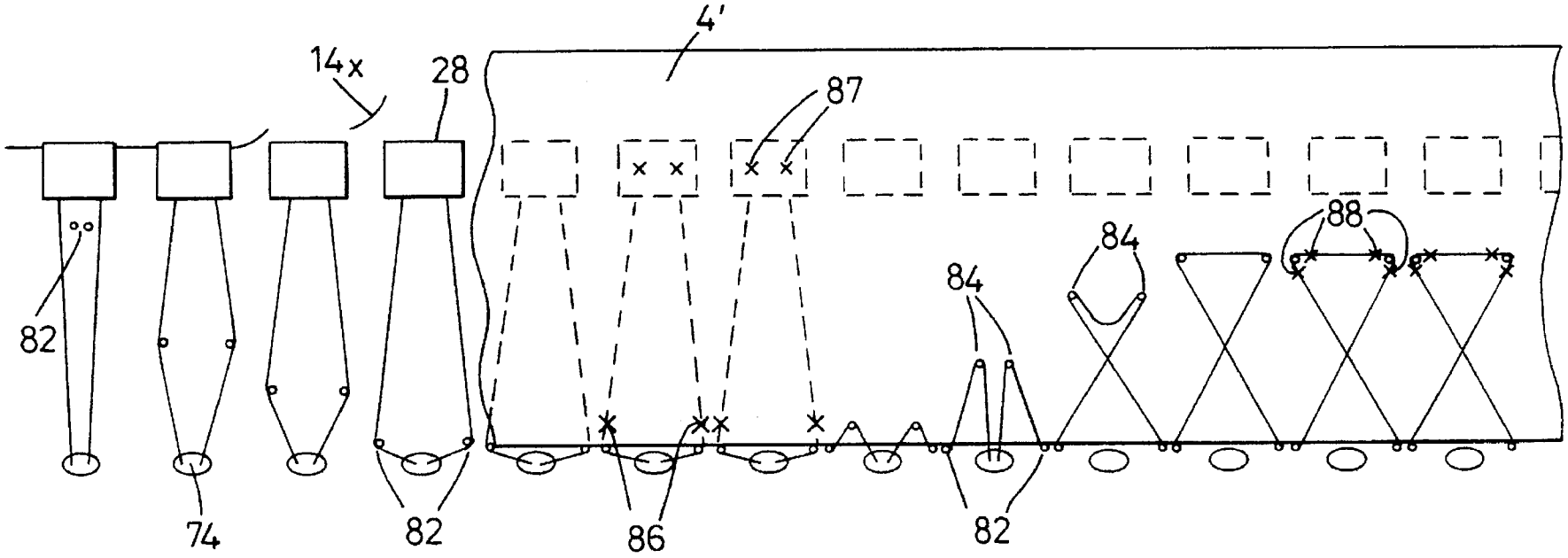
FIG. 9 is a development drawing showing the formation of the thread loop to its final shape on the second drum and its attachment to the packet envelope material.

Each suction pad 72 on the second drum has associated with it a group of four thread setting pins movable in pairs 82,84, as shown in the development drawing of FIG. 9. Cam means (not shown) control the displacement of the pins 82,84 over the second drum, analogously to the cam track associated with the hooks 62 on the first drum. The thread loops are held under a light tension by the suction through the ports 74, ready for engagement by the pins 82,84.

The first pair of pins 82 acts on the thread before the web 4' is laid onto the drum 70 over it and they spread the two lengths or sides of the loop 14' apart as they move generally axially of the drum, from the tag 28 to the suction port 74. Simultaneously, cutting means (not shown) sever and remove the lengths of thread 14*x* extending between the tags. As this stage is completed the rotation of the second drum will have carried the tag thread assembly to the point at which the web 4' is laid over it and the web is attached to the thread adjacent the first pair of pins 82 by tacking heat seals 86 and to the tags by the heat seals 87.

The second pair of setting pins 84 is now brought into action while the first pair 82 holds the spaced lengths of thread clear of the edge of the web 4'. The second pair of pins operates over the exposed outer face of the web and for clarity the later stages of operation in FIG. 9 do not show the thread lengths extending from the tags underneath the web to the pins 82 at its edge.

Initially the second pair of pins 84 bears against the shorter lengths of the thread between the first pair of pins 82 and the suction port 74, and they draw thread from the port 74 over the exposed face of the web, ie. the face opposite to that against which the tag 28 lies. As they move towards the tag, the paths of the pins 84 cross each other. Once the loop has been drawn out of it, the vacuum to the suction port can be switched off. The loop is finally shaped and held substantially taut by the four pins 82,84 in the "X" pattern shown, the thread bends around the pins 84 being destined to form the bends 18 in the packets. Before leaving the second drum 70 the thread is secured in that pattern by further heat seals or adhesive spots 88 adjacent to and on each side of the pins 84.

The web, with the tags and thread attached to it and the "X" pattern loop on its upper face, now proceeds to a filling station where the opposite longitudinal edges of the web are closed together, whether by folding about a centre line or forming into a tube (as indicated at 90 in FIG. 3) with the tags 28 on the exterior and the thread bends 18 in the interior. Doses of tea can then be dispensed into the web, and the web is sealed and severed between successive doses to form individual tea bags. The apparatus with which these steps are performed is not illustrated in any detail because they can be achieved by known means. As an example, GB 2094267A and 2151214A illustrate features of a filling and separating apparatus with which the apparatus for assembling the web, tags and thread as described above can be employed, and their disclosures are incorporated herein by reference.

In the alternative form of apparatus illustrated in FIGS. 10–14 the thread loops are indicated by the reference number 102, the tag strip by 104 and the web of envelope material by 106.

Figure 11:
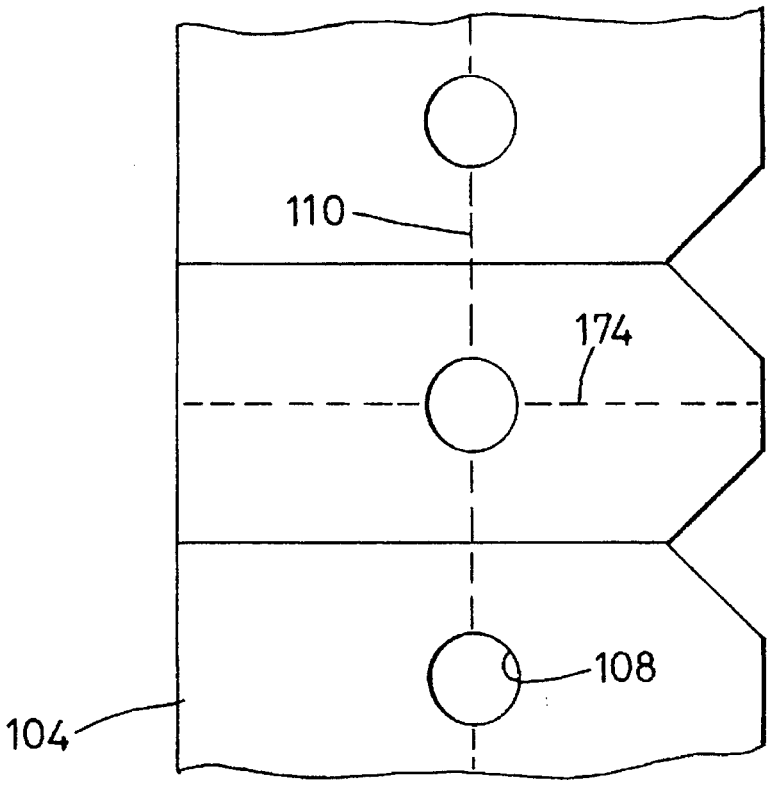
FIG. 11 illustrates the tag strip used in the apparatus of FIG. 10.

As can be seen in FIG. 11, at regular intervals along its length, the tag strip 104 has a series of holes 108 bisected by a central fold line 110 of the strip, similarly to the example in the first embodiment described. A thermoplastic coating on one face of the strip 104 allows the contacting surfaces of the strip to be adhered together when it is doubled over along the central fold line 110.

Figure 10:
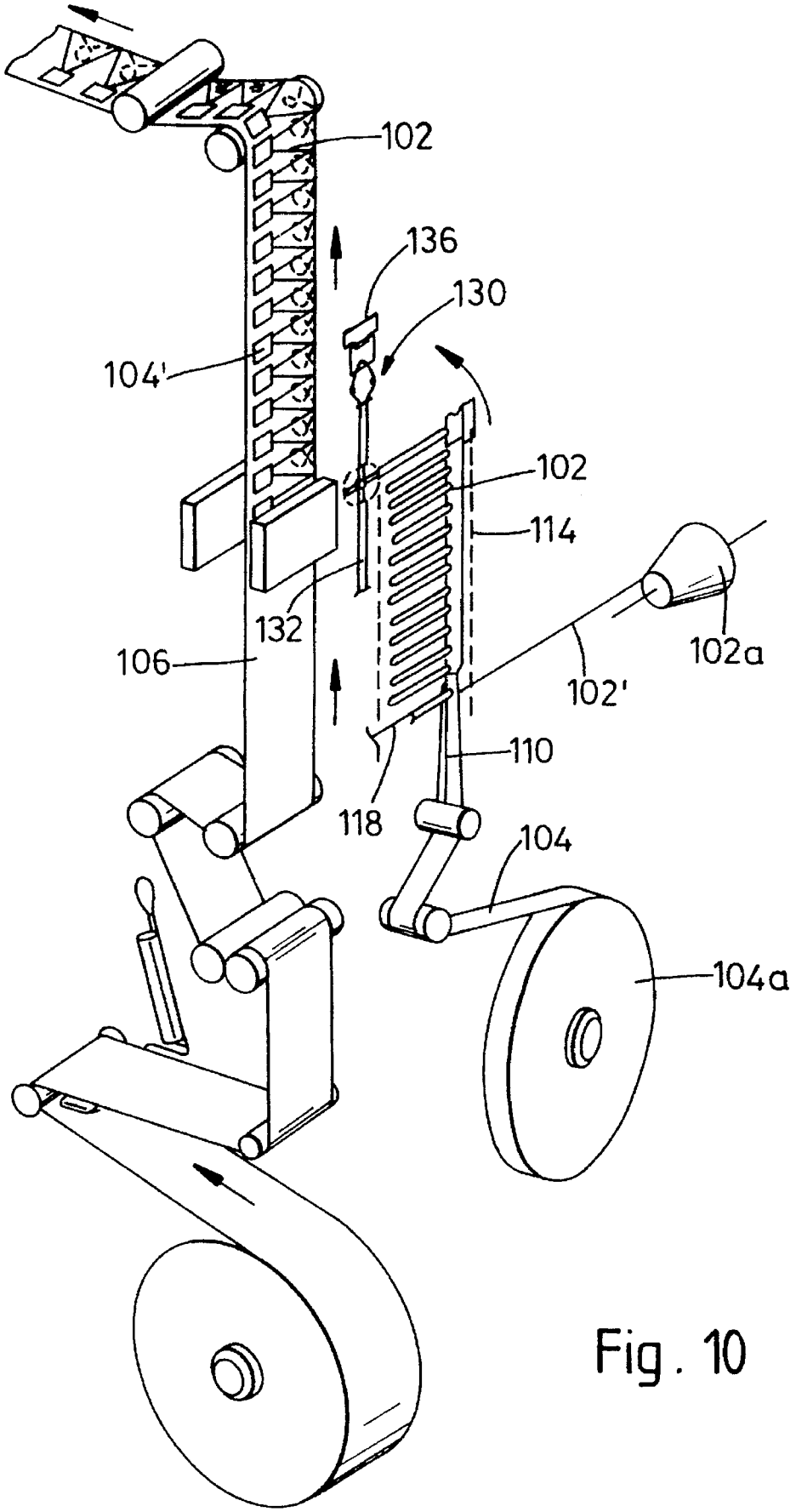
FIG. 10 is a schematic illustration of an alternative form of apparatus according to the invention.

In the apparatus of FIG. 10, the tag strip 104 is drawn from a reel 104*a* through a vertical transport device 114 not shown in detail. The device 114 moves the strip 104 in a series of steps along its upward path while it is folded about the central fold line 110. During the folding of the strip 104, and before the opposed coated surfaces come into contact, the thread 102' drawn from spool 102*a* and travelling through guide rollers 116 (FIG. 12) is introduced between the opposed surfaces. Specifically, in the intervals of rest of the strip the thread is drawn by a reciprocating hook 118 through the holes 108 in a series of loops.

Figure 12:
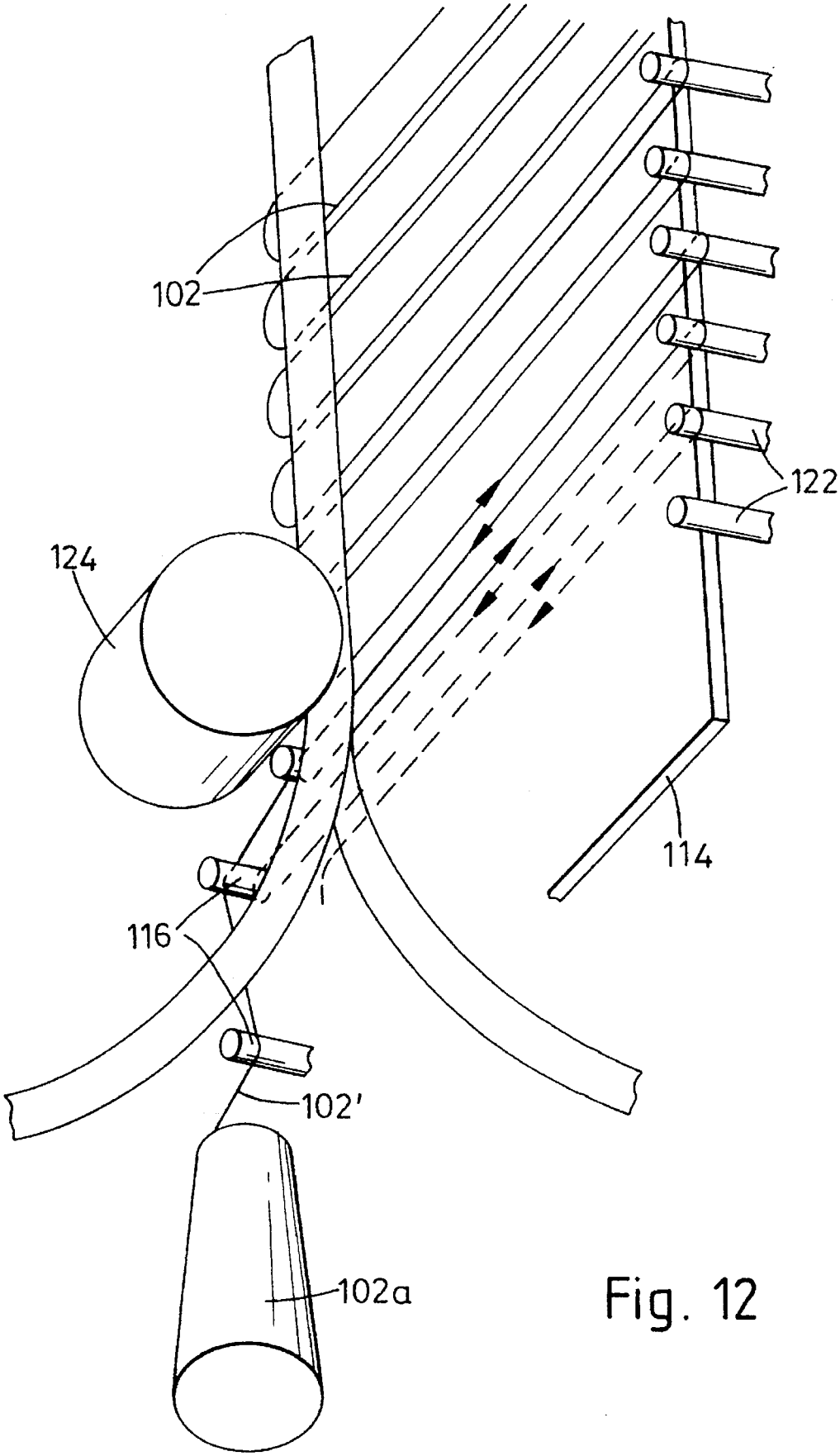
FIG. 12 shows further details of a further modified form of apparatus according to the invention.

The formation of the loops 102 is shown in more detail in FIG. 12, which also shows a modified tag strip arrangement that will be described in more detail later. To carry the thread loops 102, the transport device 114 comprises a continuous chain of carrier pegs 122 travelling a path parallel to the strip 102 and moving in synchronism with the strip. At each pause in the stepped movement, the reciprocating hook 118 draws thread from the spool 102*a* via the rollers 116 through a registering hole 108 in the strip to lay the thread around a peg 122 in a loop. Each step of the tag strip movement brings a succeeding hole of the strip and loop peg 122 into register with the hook 118. Further along the path of movement of the strip, the adjacent coated surfaces of the strip are brought together and sealed by rollers 124 one of which is shown in FIG. 12, so locking the thread loops in place on the strip. The folded strip now lies in a plane perpendicular to the axis of the reel 104*a*.

The transport device 114 brings the strip 104 of tag material, with the attached thread loops 102, to a transfer device 130 at which the individual tags 104' with their respective loops 102 are severed from the strip. The device 130, illustrated in more detail in FIG. 13, comprises a series of radial arms in the form of suction tubes 132 spaced equally around a rotary axis 134. The tubes 132 lie in a vertical plane slightly offset from the folded strip and turned at a small angle towards the plane of the folded strip 104. The rotary transfer device also comprises grippers 136 that are positioned opposite the outer ends of the tubes 132. The grippers rotate with the tubes but are displaceable radially towards and away from them.

Figure 13:
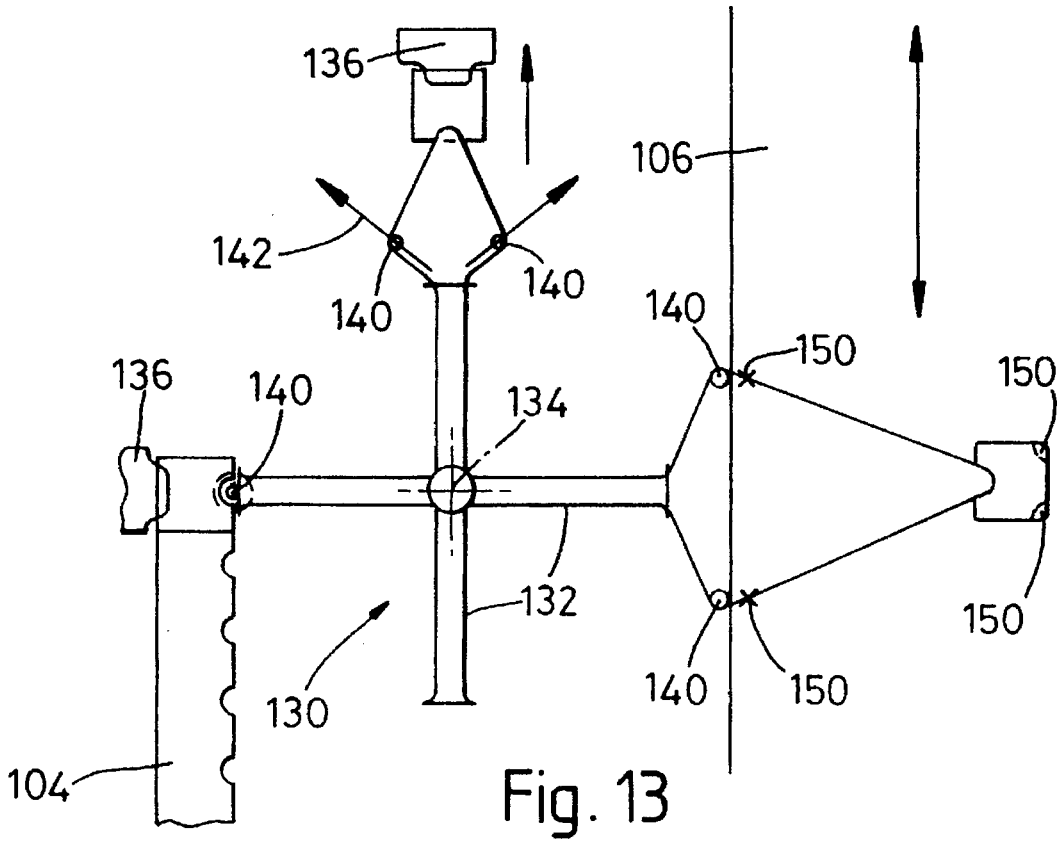
FIG. 13 shows the transfer device of the apparatus of FIG. 10 in more detail.

FIG. 13 illustrates how a gripper (at the 9 o'clock position of the device 130) holds the leading tag of the strip 102 with the transport device 114 stationary while the leading tag 104' is severed from the strip. At the same time, suction is applied through the tube 132 facing the severed tag and the thread loop 102 of that tag is detached from its carrier peg 122 to allow the suction to draw the thread loop into the tube. The transfer device 130 then indexes through 90° in the clockwise direction as seen in FIG. 13 to allow the next tag to be detached and transferred in the same manner.

The rotary transfer device 130 also comprises pairs of spreader pins 140 near the outer ends of the suction tubes 132. In a cycle of movement each pair of pins 40 initially occupies a retracted position while the thread loop is being transferred from its carrier peg 122 to the suction tube and the tag is severed from the strip. The pair of pins is then moved to a ready position (shown at the 9 o'clock position of the device 130 in FIG. 13) between the two arms of the loop. In the next indexing movement of the transfer device 130, the gripper 136 moves further away from the mouth of the tube 132 and the pins 140 move obliquely apart, as indicated by the arrows 142, to widen the loop while drawing the thread from the tube where the suction holds it under a slight tension.

After the next movement step, the tag 104' has been rotated through 180°, the gripper 136 has been moved to its outermost radial position, the spreader pins 140 have moved apart to their maximum extent, and the thread loop 102 has been partially withdrawn from the tube to lie under tension between the pins, as shown at the 3 o'clock position in FIG. 13. At this stage, the tag is aligned against the web 106 of sheet material for the packet envelopes, the web lying substantially parallel to the plane of the folded tag strip. The web 106 is similarly being advanced in steps, synchronously with the transfer device 130, and while the web and transfer device are stationary weak heat seals 150 are formed to hold the tag and thread releasably on the web. Approximately half of the length of the thread loop now lies on the web and extends over more than half the width of the web. The widened portion of the loop is held by the spreader pins 140 close to the edge of the web.

Figure 14:
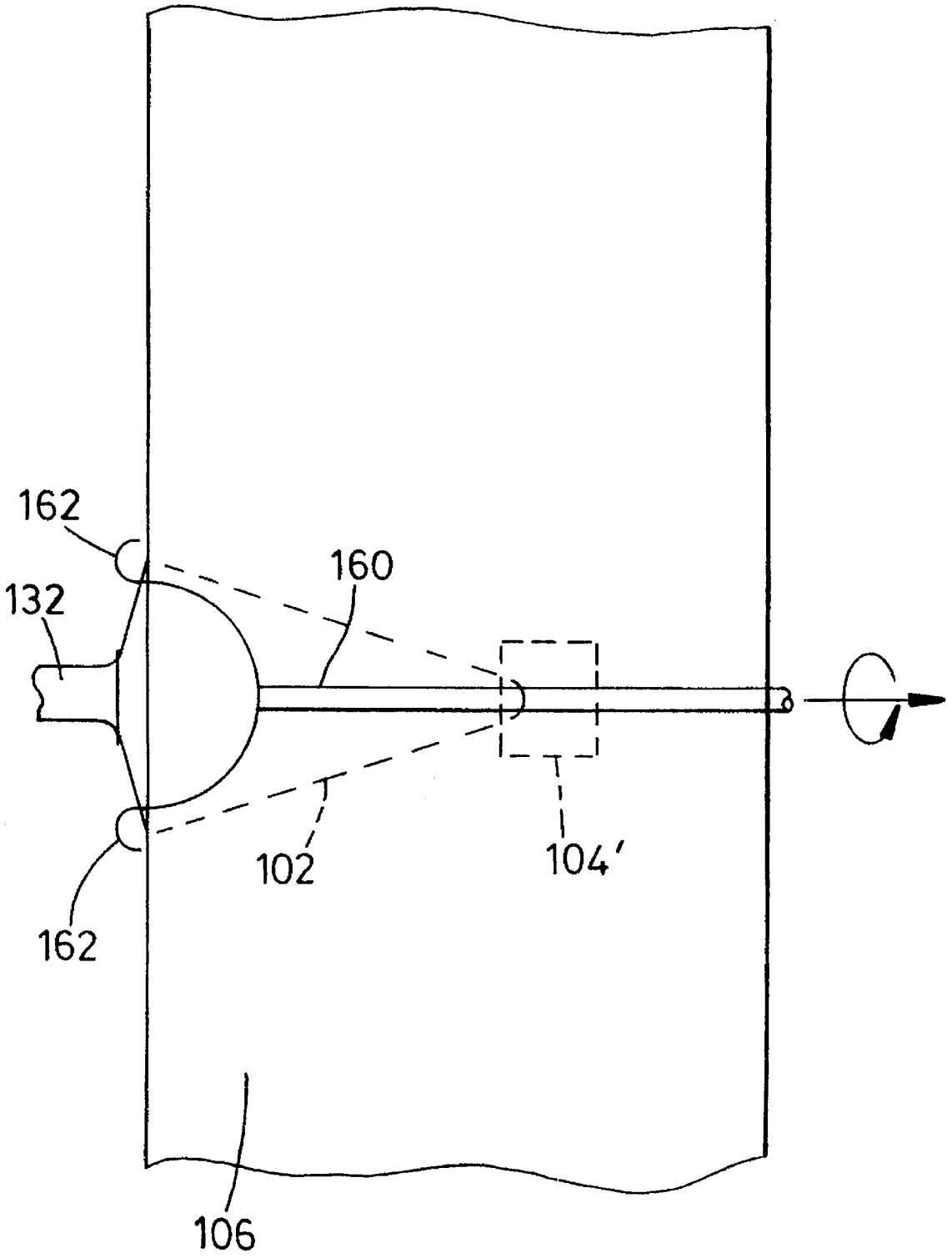
FIG. 14 illustrates a stage in the attachment of a tag and thread loop to a packet web using the apparatus of FIG. 10, FIGS. 15 to 18 illustrate alternative forms of infusion packet according to the invention.

As FIG. 14 shows in a view onto the reverse side of the web, at the 3 o'clock position illustrated in FIG. 13 a fork arm 160 projects across the width of the web 106 opposite the side on which the tag 104' is attached. Before the next indexing movement of the transfer device 130 begins, the fork arm 160 is displaced to bring a pair of hooks 162 on its forked end across the plane of the web in order to engage the thread loop 102 on the spreader pins 140. Return movement of the hooks 162 to their original side of the web plane releases the loop from the pins 140. While the next indexing movement of the transfer device begins, the hooks 162 move transversely across the reverse side of the web and to rotate through 180° about an axis extending in that direction of movement. The portion of the thread loop previously held in the suction tube 132 is thereby drawn across the web face opposite the face on which the tag lies while being twisted into an X-form extending from one edge of the web over almost half the width of the web. The thread on the reverse side of the web is now attached to the web at the ends of the arms of the X-form, on the opposite side of the centre line of the web to that occupied by the tag.

In following, unillustrated steps, the web 106 is folded over about its longitudinal centre line and divided transversely to form a series of individual packets each with the tag 104' on an external face and the X-form loop of thread 102 held between the folded faces of the packet envelope. The contents of the packets may be placed on the web before the web is folded over to envelope the contents, or at any time thereafter, but preferably before the individual packets are separated from the web. The packets may be closed by heat-sealing the web after the contents have been placed in them whether before or after they are separated from the continuous web. These steps do not require specific illustration because the means for their performance are well known in the art. As examples of such apparatus, the disclosures of EP 448325A and GB 2201934 are incorporated herein by reference.

The resultant packet has essentially the same form as that shown in FIG. 1

Figure 15:
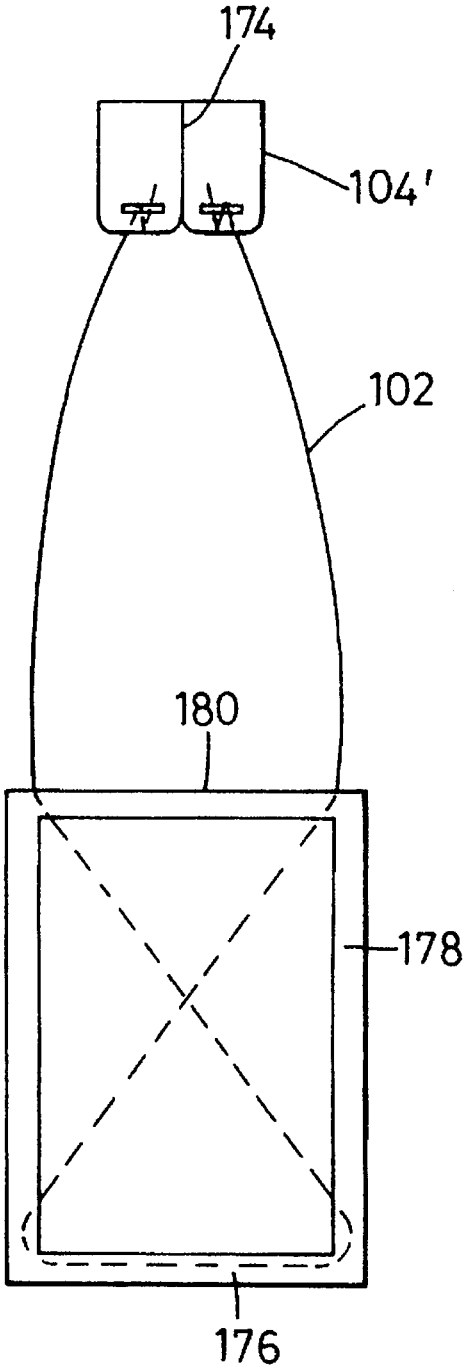
Figure 15A:
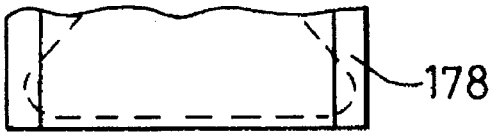
Figure 15B:
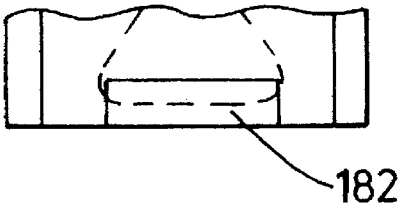
Figure 15C:
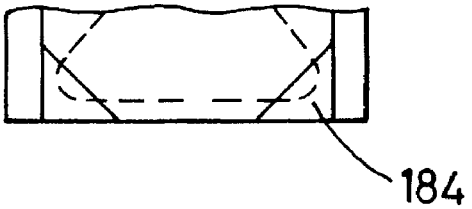

FIGS. 15*a*, 15*b*, 15*c* illustrate a number of different ways in which the lower end of the thread loop can be positioned and secured by heat sealing. In the first example of FIG. 15*a*, the folded web is not given a bottom sealed edge and the thread is held only by the lower regions of the side edge seals 178. In FIG. 15*b*, a central portion of the bottom edge has a heat seal 182 trapping the thread, which then does not extend as far as the side edges. In the example of FIG. 15*c*, the side edge seals have widened portions 184 at the bottom edge of the packet to secure the ends of the bottom run of the loop.

In a modified arrangement, the fork arm 60 does not rotate as it draws the thread loop 2 across the reverse side of the web. The thread placed against the reverse face then has in a substantially U-form pattern instead of the X-form illustrated. It may be secured in this configuration by similar heat seals to those already described and shown. It will be easily understood that a similar thread pattern can be formed when using the embodiment of apparatus first described if the paths of the pins do not cross as they draw out a thread loop.

Figure 16:
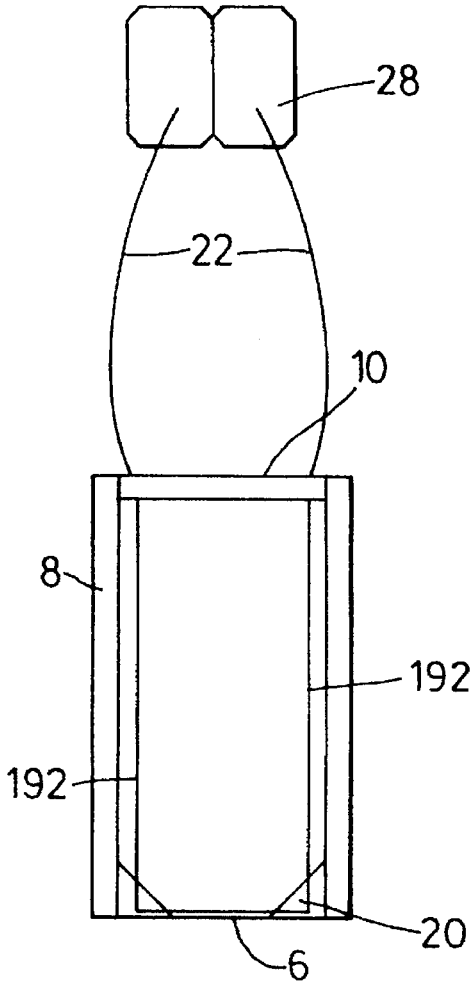
Figure 17:
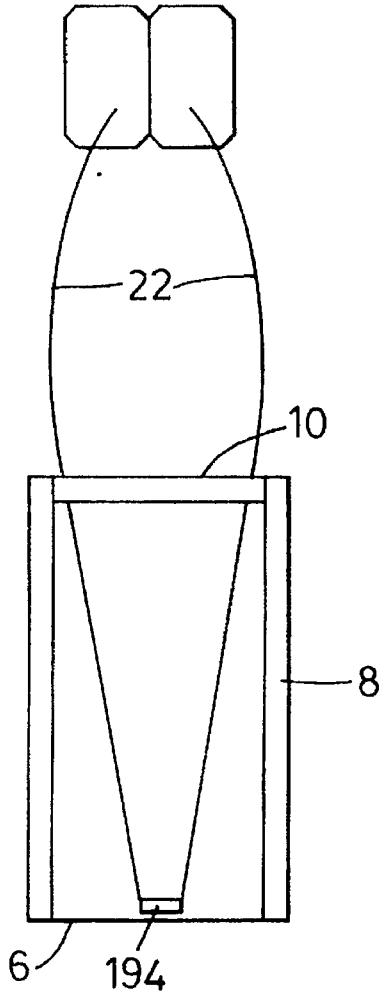
Figure 18:
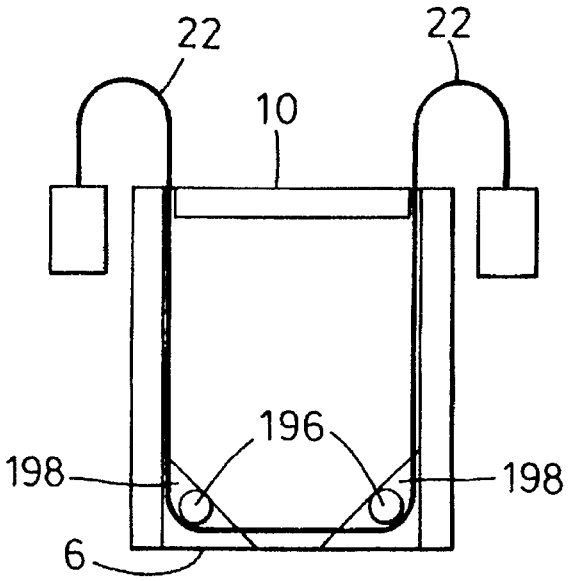

FIGS. 16 to 18 illustrate some alternative forms of packet according to the invention having substantially U-form loops. The packet of FIG. 16 is essentially the same as the example of FIGS. 1 and 2, and corresponding parts are indicated by the same reference numbers, except that the arms 192 of the internal thread loop extend from the wider heat seal regions 20 parallel to the sides of the packet.

FIG. 17 shows the thread loop retained at the opposite end from which the thread ends emerge, by an additional heat seal 194 adjacent the folded edge 6 and unconnected with the edge seals which enclose the flowable material in the packet. The example of FIG. 18 is analogous, in that there are two such additional heat seals 196, in this case spaced close to the packet corners so as to spread the squeezing effect mope widely. FIG. 18 also shows weaker heat seals 198 over the bottom corners of the packet, extending into the firmer seals 196. The corner seals 198 serve to prevent any infusion material seeping into the thread channels behind the seals 196.

In FIG. 17 separate tags are shown on the thread ends, but this is merely their ready-for-use state and they can correspond precisely to the perforated tags of the previous examples.

It will be understood that with these and other alternative forms of packet according to the invention, the means by which the parts of the packet are put in place and the sequence in which such means operate can be modified.

A preferred feature of all the examples of packets shown is formation of the envelope with a folded side edge at that end of the bag opposite the end from which the loop ends emerge. It is found that the folded edge, rather than a double-thickness welded seam, improves the infusion properties of the packet.

Referring again to FIG. 12, this also illustrates an alternative arrangement for forming the tags holding the thread loops on the tags. Two tag strips 104, each with a thermoplastic coating on one face are drawn from separate rolls through the rolls 24 where their coated faces are pressed into contact and heated to secure the strips together. Upstream of the rolls 24, the thread 2' is fed between the still separate strips in a series of loops 2 in the manner already described and the loops are secured by the sealing of the two strips together.

We claim:

1. A method of manufacturing packets containing a flowable material and provided with a length of thread for contracting the packet to squeeze its contents, comprising the steps of forming loops of the thread to lie against successive tags in a row of tags and attaching opposite ends of each loop to its associated tag, placing one face of a web of the packet envelope material against the tags and thread loops with portions of the loops remote from the tags overhanging a side edge of the web, bringing said portions of the thread loops over the opposite face of the web and attaching them thereto, and doubling over the web to a tubular form to locate said loop portions within the tubular form and the attachments of the loops to their tags on the exterior of the tubular form.

2. A method according to claim 1 wherein the stages of assembly of the tags, thread and web together are conducted as the parts of said assembly move towards a filling station, the flowable material being deposited in the tubular form web at the filling station after the thread and tags have been put in place and before dividing the web into a series of individual sealed packets.

3. A method according to claim 1 wherein the row of tags is progressed in a step-wise manner and the web material of the packet envelope is progressed step-wise in synchronism with said progressing of the tags, and wherein the placing of the web against respective tags and thread loops, the bringing said thread loop portions over the opposite face of the web and attaching them thereto being effected during the intervals between said movements.

4. Apparatus for producing packets with tag means attached to a thread or draw-string, said apparatus comprising:

transport means onto which tags and thread are brought together, means for forming loops of thread and for attaching opposite ends of the loops to respective tags to form tag-thread assemblies, means for bringing the tag-thread assemblies together with a web of envelope material and for placing the tags against one face of said web, with a portion of each loop remote from said ends overlapping a side edge of the web, means for placing said overlapping portions of the thread loops over the opposite face of the web and attaching them thereto, means for forming the web into a tubular shape with said loop portions in the interior thereof and said tagged ends on the exterior thereof, and means for heat sealing between opposite faces of the web and for separating the individual packets therefrom with a thread loop and tag associated with each said packet.

5. Apparatus according to claim 4 wherein said transport means is movable in a step-wise manner, said means for forming loops of the thread and for attaching the loops by one end to respective tags being arranged to operate between movement steps, means for progressing the web of envelope material being movable step-wise in synchronism with the movement of the tag-thread assemblies and said means for attaching said assemblies to the web being also operable in the intervals between said movements.

6. Apparatus according to claim 5 wherein said loop-forming means comprises a reciprocable member arranged to draw out loops of thread in successive intervals of said step-wise movement of the transport means.

7. Apparatus according to claim 4 comprising a further transport means to which the tag-thread assemblies are transferred from the first transport means for assembly with the web.

8. Apparatus according to claim 5 wherein said means for bringing the tag-thread assemblies together with the web comprises an indexable device movable step-wise in synchronism with said transport means, said device having means for taking the tag-thread assemblies from said transport means, and there being further transport means to which the tag-thread assemblies are transferred from the first said transport means for assembly with the web and means adjacent the web path in said further transport means for removing the tag-thread assemblies from said device.

9. Apparatus according to claim 8 wherein said tag-thread assembly removal means also provides means for placing said overlapping loop portions over the web.

* * * * *